US008601721B2

(12) United States Patent
Sills

(10) Patent No.: US 8,601,721 B2
(45) Date of Patent: Dec. 10, 2013

(54) ARTICLE OF FOOTWEAR WITH AN INTERMEDIATE SIZED OUTSOLE

(75) Inventor: Craig K. Sills, Tigard, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 13/561,440

(22) Filed: Jul. 30, 2012

(65) Prior Publication Data

US 2012/0285042 A1 Nov. 15, 2012

Related U.S. Application Data

(62) Division of application No. 12/416,575, filed on Apr. 1, 2009, now Pat. No. 8,250,692.

(51) Int. Cl.
*A43D 25/00* (2006.01)

(52) U.S. Cl.
USPC ..... 36/37; 36/100; 36/101

(58) Field of Classification Search
USPC ..... 36/97, 100, 25 R, 88, 45, 117.1–19.9
See application file for complete search history.

(56) References Cited

U.S. PATENT DOCUMENTS

| | | | | |
|---|---|---|---|---|
| 4,245,409 | A | 1/1981 | Beyl | |
| 7,428,789 | B2 | 9/2008 | Holzer et al. | |
| 7,784,814 | B2 | 8/2010 | Brandt | |
| 7,887,081 | B2 | 2/2011 | Brandt | |
| 8,210,561 | B2 * | 7/2012 | Brandt | 280/613 |
| 8,250,692 | B2 | 8/2012 | Sills | |
| 8,359,773 | B2 * | 1/2013 | Dal Bello et al. | 36/117.6 |
| 2002/0092182 | A1 | 7/2002 | Coplon et al. | |
| 2003/0106243 | A1 | 6/2003 | Tucker | |
| 2005/0210710 | A1 | 9/2005 | Chen | |
| 2008/0109969 | A1 | 5/2008 | Smith | |
| 2008/0168684 | A1 | 7/2008 | Khalifa | |
| 2010/0251576 | A1 | 10/2010 | Sills | |

FOREIGN PATENT DOCUMENTS

| | | |
|---|---|---|
| CN | 102438474 | 5/2012 |
| DE | 102007006387 | 8/2007 |
| EP | 1952711 | 8/2008 |
| EP | 2413727 | 2/2012 |
| KR | 100728075 | 6/2007 |
| WO | 2010120502 | 10/2010 |

OTHER PUBLICATIONS

International Search Report and Written Opinion, mailed Nov. 15, 2010 in International Application No. PCT/US2010/029347.
International Preliminary Report on Patentability (including Written Opinion of the ISA) mailed Oct. 13, 2011 in International Application No. PCT/US2010/029347.

* cited by examiner

*Primary Examiner* — Jila M Mohandesi
(74) *Attorney, Agent, or Firm* — Plumsea Law Group, LLC

(57) ABSTRACT

An article of footwear may include an upper with a first size and an outsole with a second size that is different from the first size. A midsole of the article of footwear may be configured with an upper portion that fits the first size of the upper and a lower portion that fits the second size of the outsole.

21 Claims, 8 Drawing Sheets

800

| ARTICLE SIZE (801) | UPPER SIZE (802) | MIDSOLE UPPER PORTION SIZE (803) | MIDSOLE LOWER PORTION SIZE (804) | OUTSOLE SIZE (805) |
|---|---|---|---|---|
| 6 (811) | 6 | 6 | 6.25 | 6.25 |
| 6.5 (812) | 6.5 | 6.5 | 6.25 | 6.25 |
| 7 (813) | 7 | 7 | 7.25 | 7.25 |
| 7.5 | 7.5 | 7.5 | 7.25 | 7.25 |
| 8 | 8 | 8 | 8.25 | 8.25 |
| 8.5 | 8.5 | 8.5 | 8.25 | 8.25 |
| 9 | 9 | 9 | 9.25 | 9.25 |
| 9.5 | 9.5 | 9.5 | 9.25 | 9.25 |
| 10 | 10 | 10 | 10.25 | 10.25 |
| 10.5 | 10.5 | 10.5 | 10.25 | 10.25 |
| 11 | 11 | 11 | 11.25 | 11.25 |
| 11.5 | 11.5 | 11.5 | 11.25 | 11.25 |
| 12 | 12 | 12 | 12.25 | 12.25 |
| 12.5 | 12.5 | 12.5 | 12.25 | 12.25 |

FIG. 8

ARTICLE OF FOOTWEAR WITH AN INTERMEDIATE SIZED OUTSOLE

CROSS-REFERENCE TO RELATED APPLICATION

This application is a divisional of prior nonprovisional application Ser. No. 12/416,575, filed Apr. 1, 2009, now U.S. Pat. No. 8,250,692, and entitled "Article of Footwear with an Intermediate Sized Outsole and Method of Making," the entire disclosure of which is incorporated herein by reference.

BACKGROUND

The present invention relates to an article of footwear, and in particular to an article with an intermediate sized outsole.

Khalifa (U.S. patent application number 2008/018684) teaches an article of footwear for mass manufacture and assembled largely without stitching. Khalifa teaches an article of footwear with an upper made from a textile. The upper is attached to a sole including an outsole, a footbed insert, and a locking strip. The outsole contains openings configured to receive projections disposed on the locking strip. Further, all three portions of the sole include an opening to receive a locking plug. During assembly, the upper is attached to the locking strip, such as by gluing. The footbed is aligned with the outsole so that the openings configured to receive the locking plug align. The locking strip is snap fitted to the outsole so that the projections on the locking strip are received into the openings on the outsole and so that the openings for receiving the locking plug on the locking strip is aligned with the corresponding openings on the outsole and the footbed insert. Finally, the locking plug is inserted through the openings in the outsole, footbed, and locking plug.

The footbed may be provided as a half size smaller than the outsole or the same size as the outsole. This is done so that the half size can be accommodated without the need for a different outsole for each whole and half size.

SUMMARY

The invention discloses an article of footwear and a method of assembling the article of footwear. In one aspect, the invention provides a method of making an article of footwear, comprising the steps of: determining a standard footwear size for the article; selecting an upper with a first size corresponding to the standard footwear size; selecting an outsole with a second size that is different from the first size; selecting a midsole with an upper portion that is associated with the first size and a lower portion that is associated with the second size; and assembling the upper portion of the midsole with the upper and assembling the lower portion of the midsole with the outsole.

In another aspect, the invention provides an article of footwear, comprising: an upper having a first standard size; an outsole having a second size that is substantially different from the first standard size; and a midsole having an upper portion with the first standard size and a lower portion with the second size.

In another aspect, the invention provides a method of making articles of footwear, comprising the steps of: producing a first upper having a first standard size and a second upper having a second standard size that is different from the first standard size; producing a first outsole and a second outsole, the first outsole and the second outsole having an intermediate size that is between the first standard size and the second standard size; producing a first midsole and a second midsole, the first midsole having a first upper portion with the first standard size and a first lower portion having the intermediate size and the second midsole having a second upper portion with the second standard size and a second lower portion having the intermediate size; associating the first upper portion of the first midsole with the first upper and the first lower portion of the first midsole with the first outsole to make a first article of footwear; and associating the second upper portion of the second midsole with the second upper and the second lower portion of the second midsole with the second outsole to make a second article of footwear.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

FIG. 8 is an exemplary embodiment of a table showing the relationship between various intermediate outsole sizes and various article sizes.

DETAILED DESCRIPTION

Figure 1:
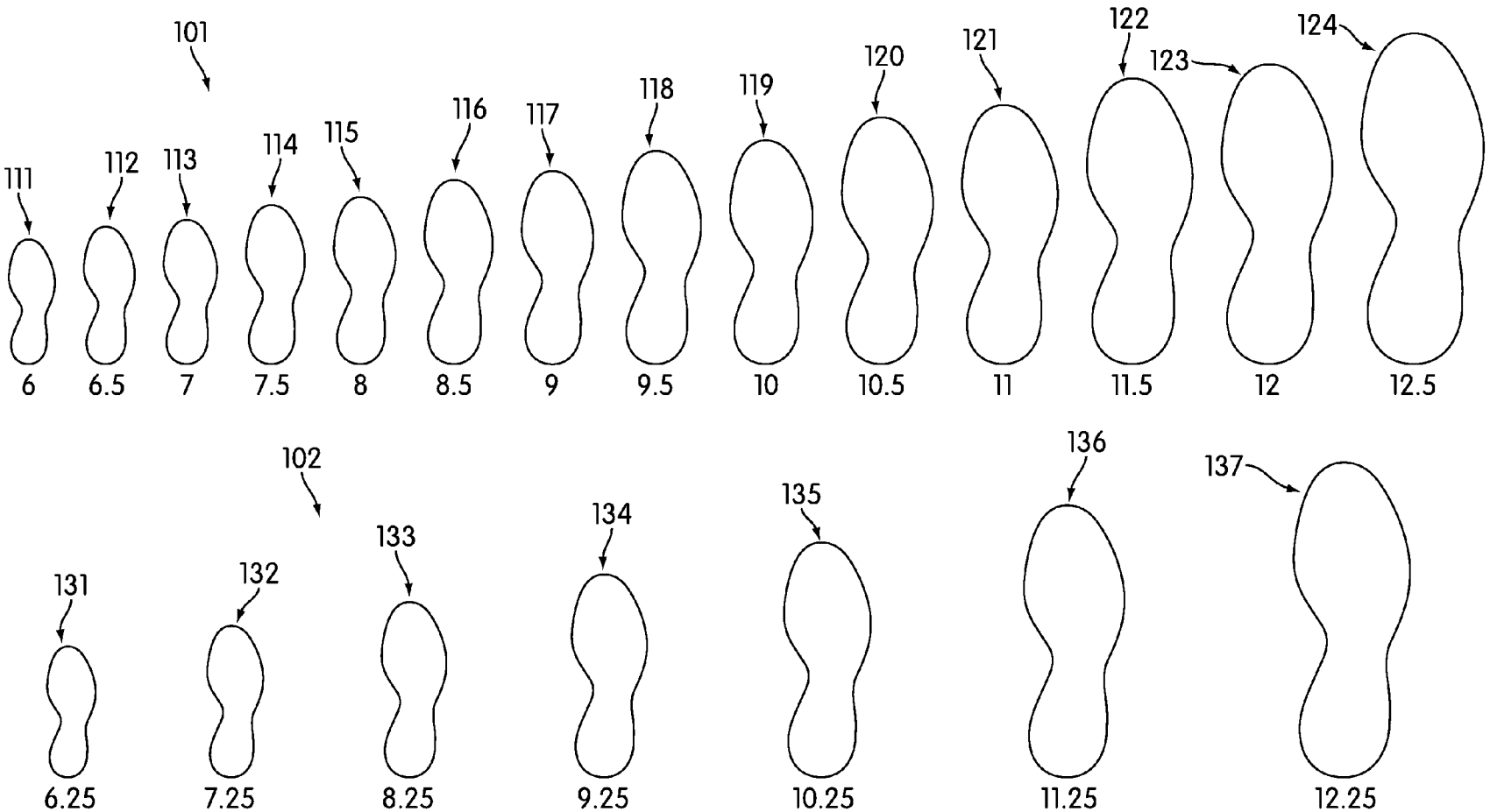
FIG. 1 is schematic view of an exemplary embodiment of a set of standard sized outsoles and a set of intermediate sized outsoles.

FIG. 1 illustrates a schematic view of an exemplary embodiment of set of standard sized outsoles 101 and set of intermediate sized outsoles 102. Outsoles of set of standard sized outsoles 101 and set of intermediate sized outsoles 102 may be associated with a bottom surface of an article of footwear. In particular, the outsoles of set of standard sized outsoles 101 and set of intermediate sized outsoles 102 may be configured to contact a ground surface.

Generally, set of standard sized outsoles 101 and set of intermediate sized outsoles 102 may include any type of outsole. For example, set of standard sized outsoles 101 and set of intermediate sized outsoles 102 may include outsoles with provisions for traction, including, but not limited to, cleats, studs and/or tread elements. In an exemplary embodiment, set of standard sized outsoles 101 and set of intermediate sized outsoles 102 comprise substantially similar types of outsoles. For purposes of clarity, the outsoles illustrated in the Figures are shown schematically and without detail.

Articles of footwear can be manufactured in standard footwear sizes. The term "footwear size" as used throughout this detailed description and in the claims, refers to a numerical designation of the fitting size of the article for a person. In other words, the footwear size may characterize the overall size of an article of footwear.

In different embodiments, footwear sizes for articles can be determined using different methods. Typically, footwear sizes are associated with a length measurement of a last. However, in some cases, footwear sizes also correspond to widths of a last. In other words, each footwear size may carry information about the length and width of the last for which the article is manufactured to fit.

In some embodiments, articles of footwear may be manufactured in standard footwear sizes. The term "standard footwear size" as used throughout this detailed description and in the claims refers to a predetermined footwear size that is manufactured for the purposes of fitting a standard size last. In some cases, the actual dimensions of an article of footwear with a standard footwear size may be estimated or approximate dimensions for fitting the standard size last. In other words, articles manufactured with a standard footwear size are not limited to having predetermined dimensions.

Typically, standard footwear sizes are given by numerical designations. In some embodiments, the numerical designation for a standard footwear size may be given in whole number and half number sizes. For example, articles of footwear may be manufactured in standard footwear sizes 6 through 15. In some cases, sizes 6 through 12.5 include whole number sizes such as 6, 7 and 8 as well as half number sizes like 6.5, 7.5 and 8.5. In other embodiments, the numerical designation could be given in only whole number sizes. In still other embodiments, standard footwear sizes may be incremented in another manner. It should be understood that the term standard footwear size is not intended to be limited to a particular type of numerical designation. It will also be understood that in still other embodiments standard footwear sizes could be given using symbolic designations other than numbers. For example, in another embodiment, standard footwear sizes could be given using letters such as size A, size B, size C, etc. In such embodiments a predetermined ordering, such as alphabetical ordering, may be given.

In some embodiments, an outsole may be configured with an outsole size. The term "outsole size", as used throughout this detailed description and in the claims, refers to the overall shape and size of the outsole. Since the shape of an outsole is typically irregular, an outsole size can be associated with a length of the outsole as well as widths at different portions of the outsole. In some embodiments, an outsole size may be associated with the maximum length of the outsole as well as a width at a forefoot portion and a heel portion of the outsole. In other embodiments, an outsole size may be associated with other footwear measurements.

In some cases, the outsole size can be associated with the standard footwear sizes discussed above. Furthermore, in some embodiments, additional components of an article of footwear can be associated with a standard footwear size. In other words, the upper may be associated with a standard upper size. Likewise, the midsole may be associated with a standard midsole size. In some cases, these standard sizes for each component correspond directly to the standard footwear size for the article. For example, if an article of footwear has a standard footwear size of 6, then the upper of that article may also have an upper size of 6. Likewise, a midsole of the article may have a midsole size of 6. Also, the outsole may have an outsole size of 6.

It should be understood that the use of standard footwear sizes in the following discussion is not meant to be limited to any particular system for designating footwear sizes. Instead, the use of footwear sizes in this discussion is meant to be understood as a general designation for standardized sizes of articles of footwear and their associated components. Moreover, the particular numerical designation for a standardized footwear size may vary from region to region as well as within different footwear categories, including footwear for men, women and children.

Referring to FIG. 1, in one embodiment, set of standard sized outsoles 101 includes fourteen outsoles. Set of standard sized outsoles 101 comprises outsoles with outsole sizes that correspond to a set of standard footwear sizes. In other words, these fourteen outsoles correspond to fourteen different sized articles of footwear that may be manufactured over a given range of standard footwear sizes. Although fourteen outsoles are included in the current embodiment, other embodiments can include more or less than fourteen outsoles.

In one embodiment, set of standard sized outsoles 101 include outsoles that range in size from size 6 to size 12.5. For example, set of standard sized outsoles 101 includes first outsole 111 that is a size 6. Likewise, set of standard sized outsoles 101 includes second outsole 112 that is a size 6.5. Similarly, third outsole 113, fourth outsole 114, fifth outsole 115, sixth outsole 116, seventh outsole 117, eighth outsole 118, ninth outsole 119, tenth outsole 120, eleventh outsole 121, twelfth outsole 122, thirteenth outsole 123 and fourteenth outsole 124 of set of standard sized outsoles 101 may be configured with sizes 7, 7.5, 8, 8.5, 9, 9.5, 10, 10.5, 11, 11.5, 12 and 12.5, respectively. With this arrangement, set of standard sized outsoles 101 includes outsoles that correspond to each standard footwear size, including whole sizes and half sizes, between size 6 and size 12.5.

For purposes of clarity, the current embodiment uses fourteen distinct outsoles in the range of sizes between 6 and 12.5. However, in other embodiments the range of standard footwear sizes could be expanded and/or limited. For example, in another embodiment, a particular type of footwear could be manufactured in a range of standard footwear sizes between size 1 and size 22. In this case, the total number of distinctly sized outsoles would be increased.

Each outsole of set of standard sized outsoles 101 may be associated with an article of footwear of the same size. For example, first outsole 111 of size 6 may be associated with an article of footwear of size 6. Similarly, second outsole 112 of size 6.5 may be associated with an article of footwear of size 6.5. With this arrangement, each outsole size represented by set of standard sized outsoles 101 may correspond to an article of footwear of the same size.

A manufacturing system for articles of footwear can include provisions for reducing the number of components used to make footwear of different sizes. In some embodiments, an outsole may be configured with an outsole size that is intermediate in size between two outsole sizes that are separated by a standard sizing increment. The term "standard sizing increment" as used throughout this detailed description and in the claims refers to the smallest possible difference between two sizes of a set of standard footwear sizes. For example, in the current embodiment that includes both whole number and half number sizes, each standard outsole size is separated from adjacent sizes by a standard sizing increment of 0.5, or a half size. For example, 6 and 6.5 are examples of two outsole sizes separated by a standard sizing increment. In another embodiment in which a set of standard footwear sizes includes only whole numbers, i.e. sizes are limited to 1, 2, 3, 4, etc.; the standard sizing increment is 1, or a whole size.

In different embodiments, an intermediate outsole size may be configured in different manners. In some cases, an intermediate outsole size may be closer in size to the larger of two outsole sizes separated by a standard sizing increment. For example, an outsole size of 6.4 is intermediate in size to an outsole size of 6 and an outsole size of size 6.5. In other embodiments, an outsole may have an intermediate size that is closer to the smaller size of two outsole sizes separated by a standard sizing increment. In one example, an outsole size of 6.1 is intermediate in size to an outsole size of 6 and an outsole size of 6.5. In an exemplary embodiment, an outsole may have an intermediate size that is an approximate arithmetic average of two outsoles sizes that are separated by a standard sizing increment. In some cases, an outsole may be configured with a quarter outsole size. In other words, the numerical value of the intermediate size is the arithmetic average of a first standard size and a second standard size separated by a standard sizing increment. For example, an outsole size of 6.25 may be intermediate to outsole sizes 6 and 6.5.

In one embodiment, set of intermediate sized outsoles 102 comprises 7 intermediate sized outsoles. In particular, set of intermediate sized outsoles 102 includes outsoles configured with quarter outsole sizes. In some cases, set of intermediate sized outsoles 102 can range in outsole size from 6.25 to 12.25. For example, first intermediate outsole 131 of set of intermediate sized outsoles 102 can have an outsole size of 6.25. Likewise, second intermediate outsole 132 of set of intermediate sized outsoles 102 can have an outsole size of 7.25. Similarly, third intermediate outsole 133, fourth intermediate outsole 134, fifth intermediate outsole 135, sixth intermediate outsole 136 and seventh intermediate outsole 137 of set of intermediate sized outsoles 102 may have outsole sizes 8.25, 9.25, 10.25, 11.25 and 12.25, respectively.

Although the exemplary embodiment discusses quarter sized outsoles with sizes between whole standard footwear sizes and the next half standard footwear sizes, other embodiments could include intermediate sizes between half standard footwear sizes and the next whole standard footwear size. For example, in another embodiment, an intermediate sized outsole with a size of 6.75 could be provided between a size 6.5 and a size 7. In other words, in another embodiment a set of intermediate sized outsoles could be provided in sizes 5.75, 6.75, 7.75, 8.75, 9.75, 10.75 and 11.75 for standard footwear sizes ranging between size 5.5 and size 12.

Figure 2:
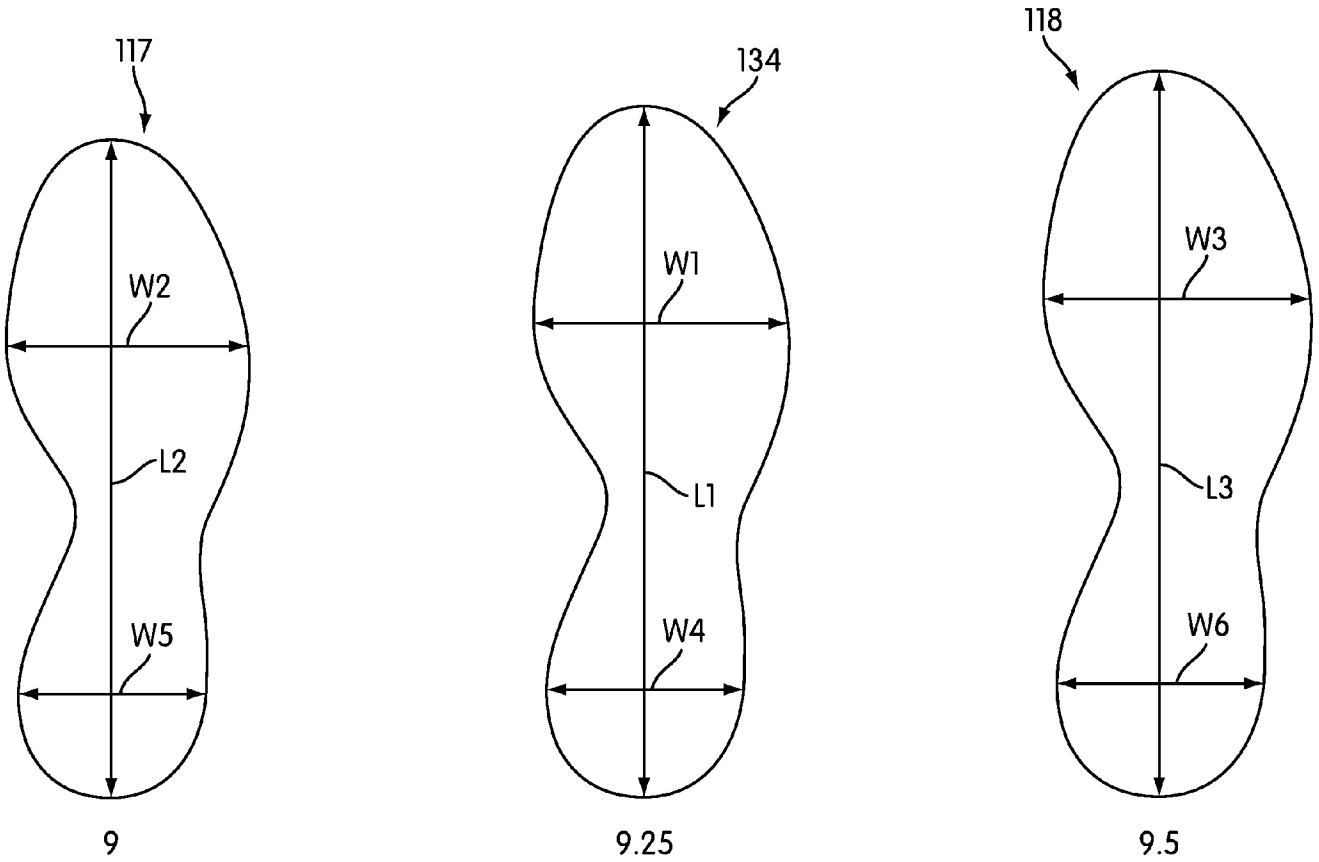
FIG. 2 is a schematic view of an exemplary embodiment of three outsoles of different sizes.

FIG. 2 illustrates an exemplary embodiment of an intermediate outsole with a size that is approximately the arithmetic average of the nearest whole and half sizes. Referring to FIG. 2, fourth intermediate outsole 134 has a size of 9.25 that is intermediate in size to seventh outsole 117 of outsole size 9 and eighth outsole 118 of outsole size 9.5.

In some embodiments, the overall length of an outsole with an intermediate size may be disposed intermediate of the lengths of the nearest whole size and half size outsoles. In one embodiment, fourth intermediate outsole 134 is configured with first length L1. Similarly, seventh outsole 117 has second length L2. Likewise, eighth outsole 118 has third length L3. Typically, second length L2 and third length L3 may be different values that correspond to an outsole size 9 and an outsole size 9.5, respectively. In some cases, the difference between second length L2 and third length L3 may be approximately 4.23 millimeters (mm). However, in other cases, the difference may be smaller or larger. In order to configure fourth intermediate outsole 134 with an arithmetic average of second length L2 and third length L3, first length L1 may be approximately 2.11 mm, or approximately half of 4.23 mm, larger than second length L2 and approximately 2.11 mm smaller than third length L3. With this arrangement, fourth intermediate outsole 134 may be configured with first length L1 that is an approximate arithmetic average of second length L2 and third length L3 of seventh outsole 117 and eighth outsole 118, respectively.

In some embodiments, the forefoot width of an outsole with an intermediate size may be disposed intermediate of the forefoot widths of the nearest whole size and half size outsoles. In one embodiment, fourth intermediate outsole 134 may be configured with first forefoot width W1 at a forefoot portion of fourth intermediate outsole 134. In addition, seventh outsole 117 may have second forefoot width W2 at the approximately same forefoot portion of seventh outsole 117. Finally, eighth outsole 118 may have third forefoot width W3 at the approximately same forefoot portion of eighth outsole 118.

In some embodiments, second forefoot width W2 and third forefoot width W3 may differ by approximately 2.11 mm. In other embodiments, second forefoot width W2 and third forefoot width W3 may differ by more or less than 2.11 mm. In one embodiment, first forefoot width W1 may be approximately 1.06 mm, or approximately half of 2.11 mm, larger than second forefoot width W2 of seventh outsole 117. Also, first forefoot width W1 may be approximately 1.06 mm smaller than third forefoot width W3 of eighth outsole 118. Using this configuration, first forefoot width W1 of fourth intermediate outsole 134 may be an approximate arithmetic average of second forefoot width W2 and third forefoot width W3.

It should be understood that the width and length of other portions of fourth intermediate outsole 134 may also be an approximate arithmetic average of the widths and lengths of corresponding portions of seventh outsole 117 and eighth outsole 118. For example, first heel width W4 of a heel portion of fourth intermediate outsole 134 may be an arithmetic average of second heel width W5 of a heel portion of seventh outsole 117 and third heel width W6 of a heel portion of eighth outsole 118. In some embodiments, second heel width W5 and third heel width W6 may differ by approximately 1.05 mm. In other embodiments, second heel width W5 and third heel width W6 may differ by more or less than 1.05 mm. In one embodiment, first heel width W4 may be approximately 0.50 mm larger than second heel width W5. Also, first heel width W4 may be approximately 0.50 mm smaller than third heel width W6. Using this arrangement, first heel width W4 may be an approximate arithmetic average of second heel width W5 and third heel width W6.

With this configuration, set of intermediate sized outsoles 102 may include outsoles configured with lengths and widths that are approximate arithmetic averages of the lengths and widths of the nearest whole and half sizes of set of standard sized outsoles 101. For example, first intermediate outsole 131 of outsole size 6.25 may have a length, forefoot width and heel width that are approximate arithmetic averages of the lengths, forefoot widths and heel widths of first outsole 111 of outsole size 6 and second outsole 112 of outsole size 6.5 of set of standard sized outsoles 101.

In some embodiments, an outsole of an intermediate size may be associated with more than one size of an article of footwear. In some cases, a quarter sized outsole may be associated with the nearest whole standard footwear size and half standard size of an article of footwear. This can increase the efficiency of outsole manufacturing by eliminating the need for a unique outsole size for each whole size and half size article.

Figure 3:
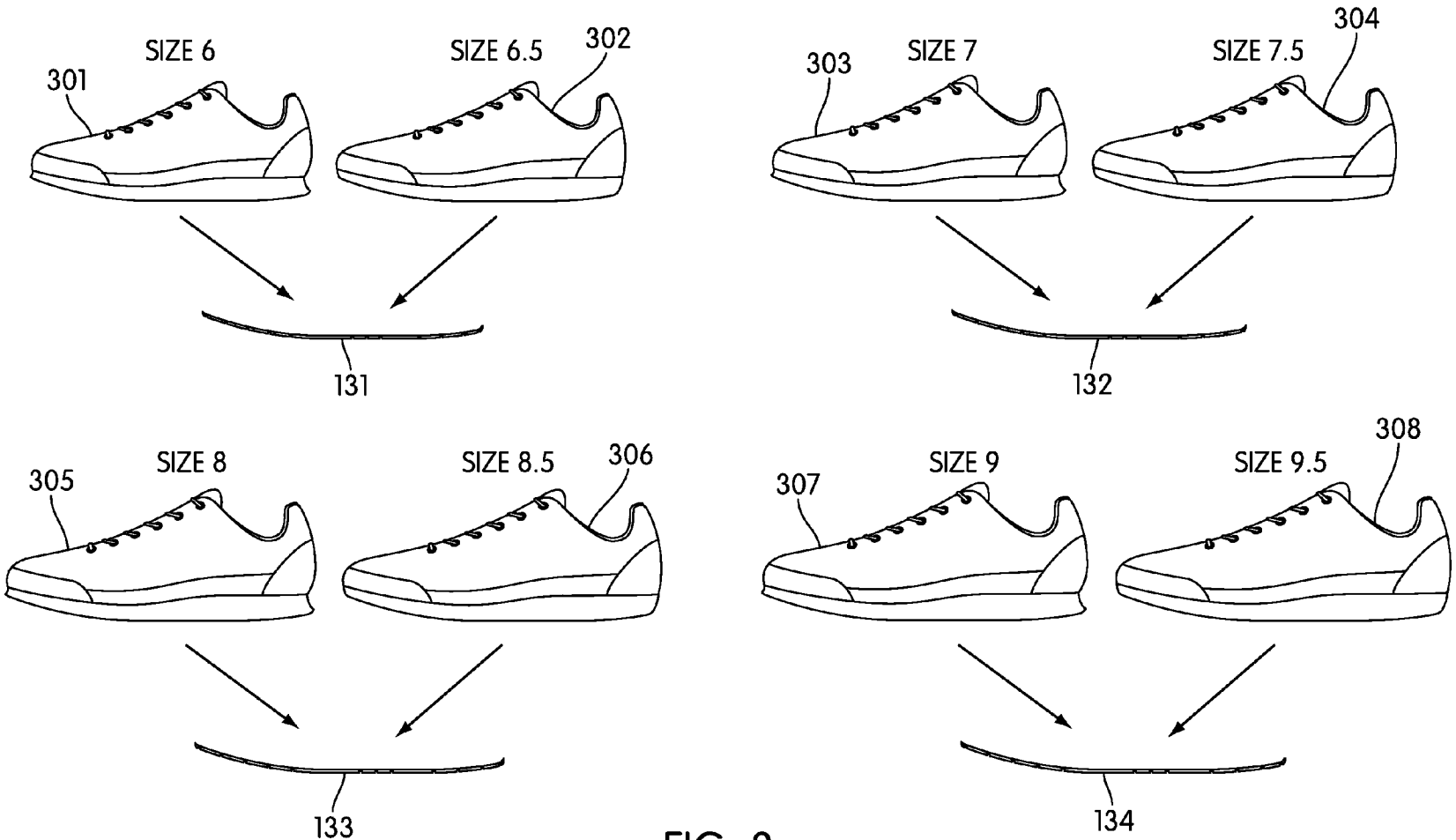
FIG. 3 is a side view of an exemplary embodiment of articles of footwear of different standard sizes associated with outsoles of a quarter size.

FIG. 3 illustrates an exemplary embodiment of articles of footwear of different standard footwear sizes associated with outsoles of a quarter outsole size. In one embodiment, first intermediate outsole 131 of outsole size 6.25 may be associated with first article 301 of size 6 as well as second article 302 of size 6.5. In other words, articles of footwear manufactured in standard sizes 6 and 6.5 may include outsoles of intermediate size 6.25. Similarly, second intermediate outsole 132 of outsole size 7.25 may be associated with third article 303 of size 7 and fourth article 304 of size 7.5. Likewise, third intermediate outsole 133 of outsole size 8.25 may be associated with fifth article 305 of size 8 and sixth article 306 of size 8.5. Finally, fourth intermediate outsole 134 of outsole size 9.25 may be associated with seventh article 307 of size 9 and eighth article 308 of size 9.5. By providing a single outsole size for whole and half number sizes, the manufacturing costs associated with making footwear can be reduced.

It should be understood that additional sizes of articles of footwear may also be associated with quarter outsole sizes. The standard footwear sizes illustrated here are only intended to be exemplary. It will be understood that any articles manufactured in a whole number and nearest half number standard footwear size can be associated with outsoles of an intermediate size between the whole number and half number sizes.

Figure 4:
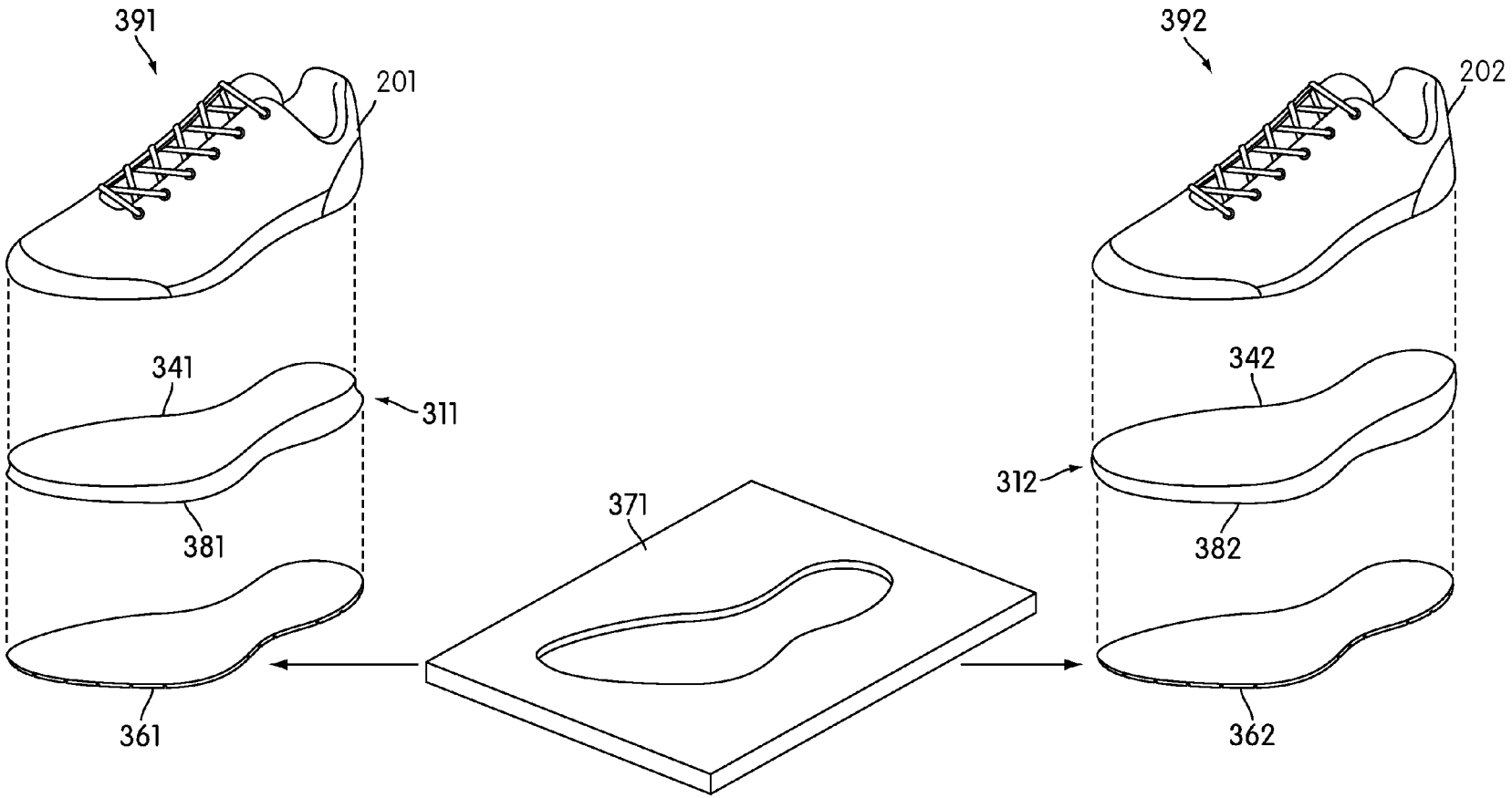
FIG. 4 is a schematic view of a method of making articles of footwear of different footwear sizes using outsoles of the same outsole size.

FIG. 4 illustrates a schematic embodiment of a process for manufacturing two articles of footwear of different standard footwear sizes using two outsoles with a single intermediate size. Referring to FIG. 4, a manufacturer may produce first upper 201 having a first standard footwear size and second upper 202 having a second standard footwear size that is larger than the first standard footwear size. In this exemplary embodiment, the first standard footwear size and the second standard footwear size may be separated by a standard sizing increment. In other words, the first standard footwear size may be a whole number size and the second standard footwear size may be the next nearest half number size.

Generally, first upper 201 and second upper 202 may be produced using any methods known in the art for making uppers. In some cases, first upper 201 and second upper 202 can be stitched or woven uppers. In other cases, first upper 201 and second upper 202 can be made in another manner.

The exemplary process can also include a step of producing first outsole 361 and second outsole 362. In some cases, first outsole 361 and second outsole 362 may both be associated with a same intermediate footwear size. In particular, the intermediate footwear size may be a size between the first standard footwear size and the second standard footwear size of the first upper 201 and the second upper 202, respectively.

In different embodiments, first outsole 361 and second outsole 362 can be produced in any manner known in the art for making outsoles. In one embodiment, first outsole 361 and second outsole 362 can both be produced using die 371. In particular, first outsole 361 and second outsole 362 can be rubber outsoles produced using a die casting process. With this arrangement, the number of dies needed to produce outsoles may be reduced from traditional systems that may require a separate die for each standard footwear size. This arrangement can help reduce manufacturing costs. In other embodiments, however, first outsole 361 and second outsole 362 could be manufactured in another manner.

The exemplary embodiment can also include a step of producing first midsole 311 and second midsole 312. In different embodiments, first midsole 311 and second midsole 312 can be made using any methods known in the art for producing midsoles. In some embodiments, first midsole 311 and second midsole 312 may be produced using die casting techniques. In other embodiments, first midsole 311 and second midsole 312 can be stamped from a bulk material. In still other embodiments, first midsole 311 and second midsole 312 may be made in another manner.

In an exemplary embodiment, first midsole 311 and second midsole 312 may be produced with slightly different sizes. In particular, first midsole 311 may include first upper portion 341 that has the first standard footwear size in order to fit with first upper 201. In contrast, second midsole 312 may include second upper portion 342 that has the second standard footwear size in order to fit with second upper 202.

For purposes of receiving first outsole 361 and second outsole 362, first midsole 311 and second midsole 312 may include first lower portion 381 and second lower portion 382, respectively. Because first outsole 361 and second outsole 362 are each associated with the same intermediate footwear size, first lower portion 381 and second lower portion 382 may also both be associated with the intermediate footwear size.

In order to produce first midsole 311 with first upper portion 341 and first lower portion 381 of differing sizes, first midsole 311 may be manufactured with a graded, or contoured, outer peripheral edge that widens from first upper portion 341 to first lower portion 381. In a similar manner, in order to produce second midsole 312 with second upper portion 342 and second lower portion 382 with differing sizes, second midsole 312 may be manufactured with a graded, or contoured, outer peripheral edge that narrows from second upper portion 342 to second lower portion 382. A detailed discussion of this grading is discussed below with respect to another embodiment.

Once first upper 201, first midsole 311 and first outsole 361 have been produced, these components can be assembled to make first article of footwear 391. In particular, first upper 201 can be assembled with first upper portion 341 and first outsole 361 can be assembled with first lower portion 381. In a similar manner, once second upper 202, second midsole 312 and second outsole 362 have been produced, these components can be assembled to make second article of footwear 392. In particular, second upper 202 can be assembled with second upper 342 and second outsole 362 can be assembled with second lower portion 382.

Figure 5:
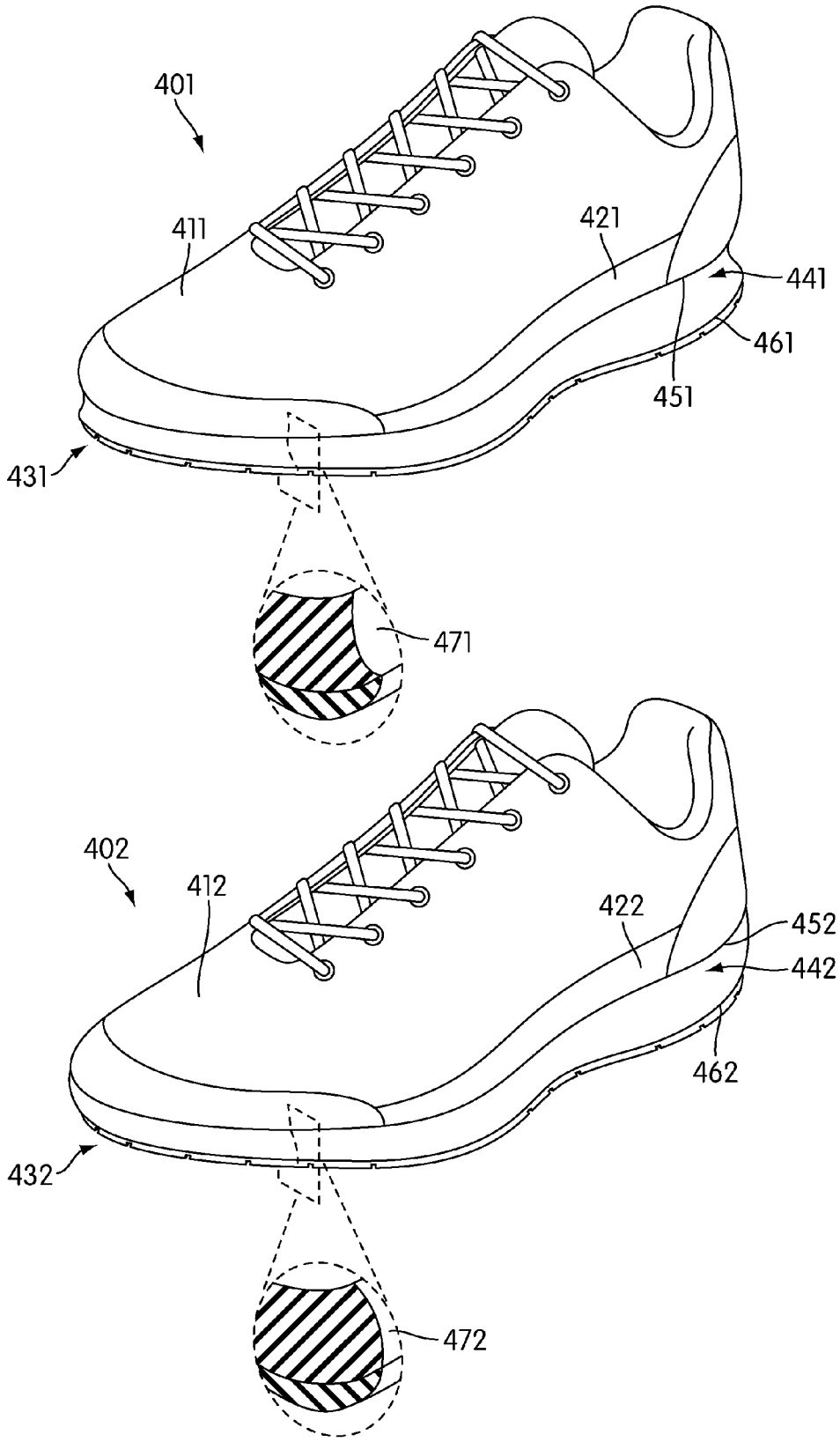
FIG. 5 is an isometric view of an exemplary embodiment of two articles of footwear of different sizes with enlarged views of cross sectional profile shapes of two outer peripheral edges.
Figure 6:
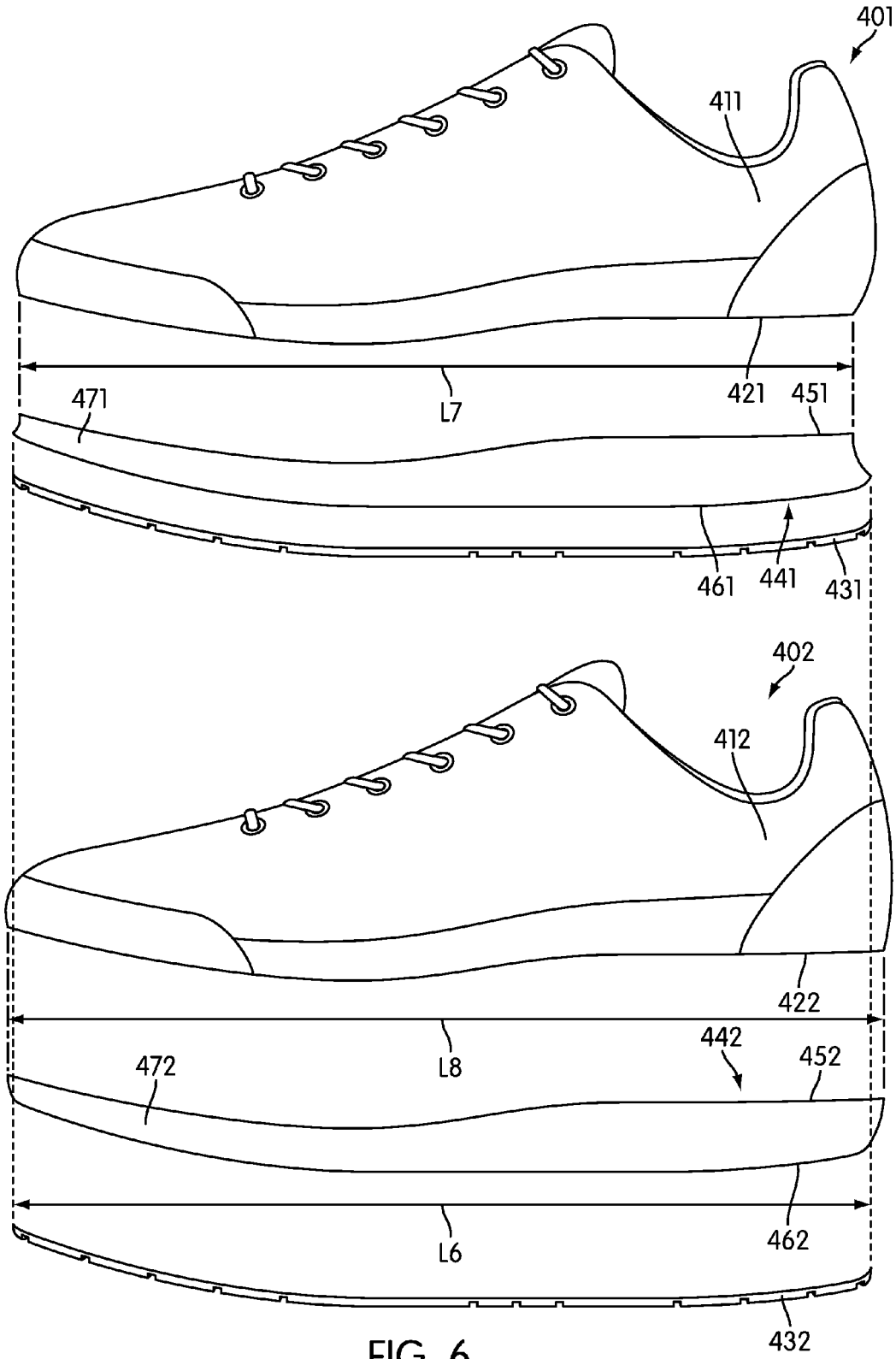
FIG. 6 is a an exploded side view of an exemplary embodiment of two articles of footwear that have different sizes.
Figure 7:
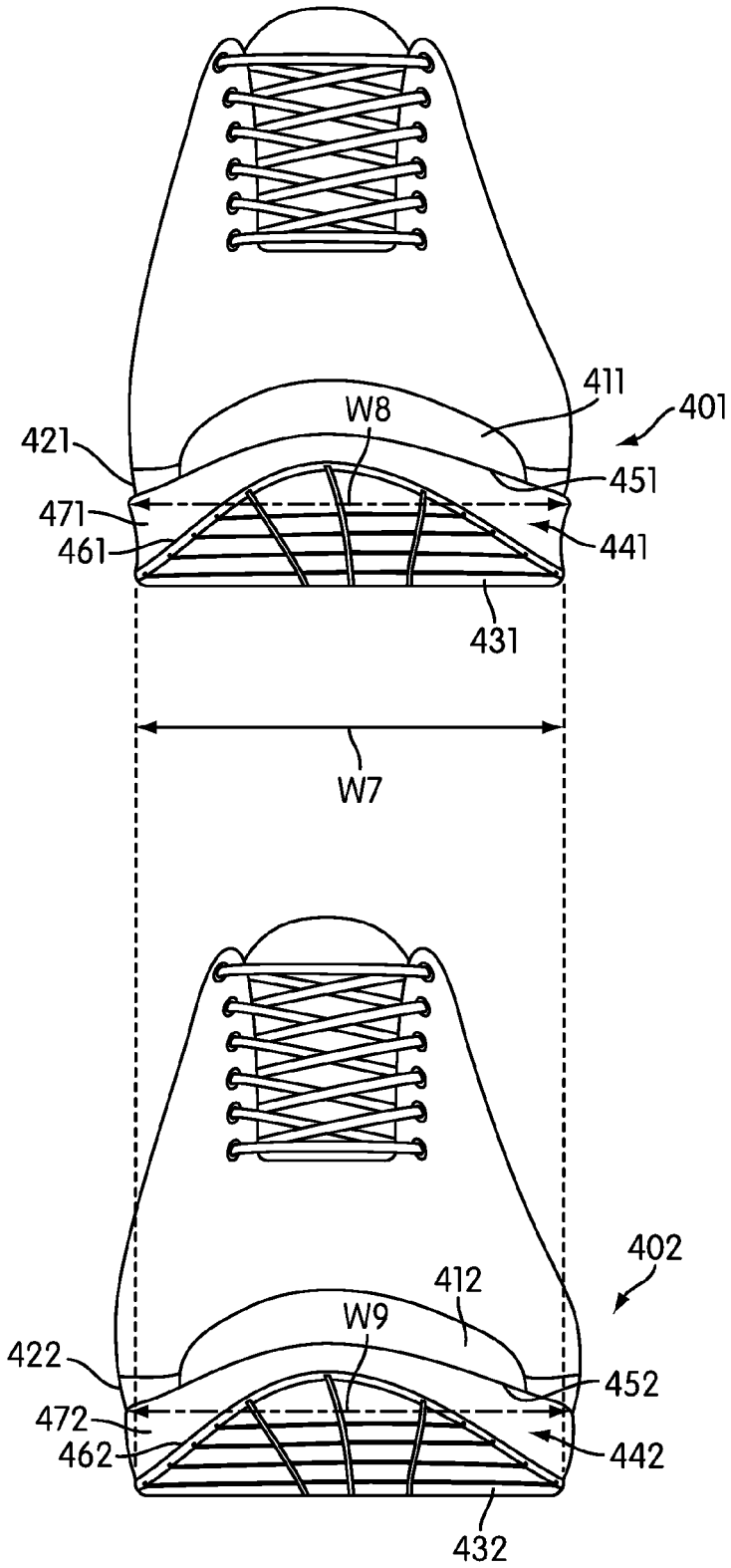
FIG. 7 is a front view of an exemplary embodiment of two articles of footwear that have different sizes.

FIGS. 5-7 illustrate an exemplary embodiment of two articles of footwear of two different standard footwear sizes that have been made using two outsoles with the same intermediate size. Referring to FIG. 5, this exemplary embodiment includes first article of footwear 401 and second article of footwear 402. Generally, first article of footwear 401 and second article of footwear 402, also referred to as first article 401 and second article 402, may be any type of article of footwear. For clarity, the following detailed description discusses an exemplary embodiment, in the form of a sneaker, but it should be noted that the present invention could take the form of any article of footwear including, but not limited to hiking boots, soccer shoes, football shoes, rugby shoes, baseball shoes as well as other kinds of shoes. As shown in FIGS. 5-7, first article 401 and second article 402 are intended to be used with a right foot; however, it should be understood that the following discussion may equally apply to a mirror image of first article 401 and second article 402 that is intended for use with a left foot.

First article of footwear 401 and second article of footwear 402 are substantially similar types of footwear. In some embodiments, first article 401 and second article 402 may be identical types and styles of footwear. However, first article 401 and second article 402 have been manufactured to have different sizes. In some cases, first article 401 may be a whole size and second article 402 may be the nearest half size larger. For example, in one embodiment, first article 401 may be manufactured as a size 9 and second article 402 may be manufactured as a size 9.5.

First article 401 includes first upper 411. Similarly, second article 402 includes second upper 412. First upper 411 and second upper 412 may be any type of upper. In particular, first upper 411 and second upper 412 could have any design, shape, size and/or color.

Typically, the size of an upper will be the same size as the article of footwear. For example, first upper 411 is configured with a first size of size 9 that is the same size as first article 401. In a similar manner, second upper 412 is configured with a second size of size 9.5 that is the same size as second article 402.

Generally, the dimensions of an upper vary over the height of the upper, since the upper has a non-uniform shape. In some cases, it may be useful to define the size of an upper with respect to a base portion that is configured to contact one or more components of a sole. In an exemplary embodiment, first upper 411 includes first base portion 421. Likewise, second upper 412 includes second base portion 422. First base portion 421 and second base portion 422 may be configured to contact a sole of first article 401 and second article 402, respectively.

With the different sizes of first article 401 and second article 402, first base portion 421 and second base portion 422 may be configured with different sizes. Referring to the exploded view illustrated in FIG. 6, first base portion 421 may be configured with seventh length L7. Likewise, second base portion 422 may be configured with eighth length L8. Eighth length L8 may be longer than seventh length L7 due to the greater size of second article 402 than first article 401.

Second base portion 422 may also be wider than first base portion 421. Referring to FIG. 7, first base portion 421 may be associated with eighth forefoot width W8. Similarly, second base portion 422 may be associated with ninth forefoot width W9. Eighth forefoot width W8 may be smaller than ninth forefoot width W9 due to the smaller size of first base portion 421 than second base portion 422.

Despite the different sizes of first article 401 and second article 402, first article 401 and second article 402 may be associated with substantially similar sized outsoles. In one embodiment, first article 401 may be associated with first outsole 431. In a similar manner, second article 402 may be associated with second outsole 432. In an exemplary embodiment, first outsole 431 and second outsole 432 may be substantially similar to fourth intermediate outsole 134, as illustrated in FIG. 2. In particular, first outsole 431 and second outsole 432 may be configured with an intermediate outsole size of 9.25.

In some embodiments, the intermediate outsole size 9.25 of first outsole 431 and second outsole 432 may be associated with a particular length and/or width measurement. In the current embodiment, first outsole 431 and second outsole 432 have sixth length L6, as seen in FIG. 6. Also, first outsole 431 and second outsole 432 may have seventh forefoot width W7, as illustrated in FIG. 7.

The size of first outsole 431 and second outsole 432 may be substantially different from the size of first upper 411 and second upper 412. Referring to FIG. 6, sixth length L6 of first outsole 431 and second outsole 432 may be substantially different than seventh length L7 of first base portion 421. In some cases, sixth length L6 may be longer than seventh length L7. Also, sixth length L6 may be substantially different from eighth length L8 of second base portion 422. In some cases, sixth length L6 may be shorter than eighth length L8 of second base portion 422. In other words, sixth length L6 may be intermediate in length to seventh length L7 and eighth length L8.

In addition, the forefoot width of first outsole 431 and second outsole 432 may be substantially different from the forefoot width of first base portion 421 and second base portion 422. Referring to FIG. 7, seventh forefoot width W7 of first outsole 431 and second outsole 432 may be substantially different from eighth forefoot width W8 of first base portion 421. In some cases, seventh forefoot width W7 may be wider than eighth forefoot width W8. Likewise, seventh forefoot width W7 may be substantially different from ninth forefoot width W9 of second base portion 422. In some cases, seventh forefoot width W7 may be narrower than ninth forefoot width W9. In other words, seventh forefoot width W7 may be intermediate in size to eighth forefoot width W8 and ninth forefoot width W9.

An article of footwear can include provisions to accommodate a difference in sizes of an upper and an outsole. In some embodiments, a midsole may be graded or contoured to align with and fit a first size of an upper and a second size of an outsole, which is different from the first size. In some cases, an upper portion of a midsole may be configured to fit a first size of an upper. Furthermore, a lower portion of a midsole may be configured to fit a second size of an outsole. With this arrangement, a midsole may accommodate different sizes of an upper and an outsole.

Referring to FIGS. 5-7, first article 401 includes first midsole 441. First midsole 441 includes first upper portion 451 that may be associated with first upper 411. Also, first midsole 441 includes first lower portion 461 that may be associated with first outsole 431. In a similar manner, second article 402 includes second midsole 442. Second midsole 442 may include second upper portion 452. Second upper portion 452 may be associated with second upper 412. Likewise, second midsole 442 can include second lower portion 462 that may be associated with second outsole 432.

In order to fit an outsole, a lower portion of a midsole may be configured with a substantially similar size as an outsole size. Referring to FIG. 6, first lower portion 461 of first midsole 441 is configured with a length substantially similar to sixth length L6 of first outsole 431. Likewise, second lower portion 462 of second midsole 442 is configured with a length substantially similar to sixth length L6 of second outsole 432. With this arrangement, first lower portion 461 and second lower portion 462 may be configured to fit first outsole 431 and second outsole 432, respectively, in a lengthwise direction.

In addition, first lower portion 461 and second lower portion 462 may have a width that is substantially similar to the width of first outsole 431 and second outsole 432. For example, referring to FIG. 7, first lower portion 461 may have a forefoot width that is substantially similar to seventh forefoot width W7 of first outsole 431. Also, second lower portion 462 can have a forefoot width that is substantially similar to seventh forefoot width W7. Although not illustrated in FIG. 7, it should be understood that additional portions of first lower portion 461 and second lower portion 462 may have substantially similar widths as portions of first outsole 431 and second outsole 432. For example, first lower portion 461 and second lower portion 462 may be configured with heel widths that are substantially similar to the heel width of first outsole 431 and second outsole 432. Using this arrangement, first lower portion 461 and second lower portion 462 may be configured to fit first outsole 431 and second outsole 432, respectively, in a widthwise direction.

In a similar manner, an upper portion of a midsole may be configured with a size that fits an upper. Referring to FIG. 6, first upper portion 451 of first midsole 441 may have a length substantially similar to seventh length L7 of first upper 411. Likewise, second upper portion 452 of second midsole 442 can have a length substantially similar to eighth length L8 of second upper 412. As previously discussed, seventh length L7 is different from eighth length L8 reflecting the different sizes of first upper 411 of size 9 and second upper 412 of size 9.5.

In addition, first upper portion 451 of first midsole 441 may have a forefoot width that is substantially similar to eighth forefoot width W8 of first upper 411, as illustrated in FIG. 7. Also, second upper portion 452 of second midsole 442 may have a forefoot width that is substantially similar to ninth forefoot width W9 of second upper 412. As previously discussed, eighth forefoot width W8 and ninth forefoot width W9 are substantially different and reflect the different sizes of first upper 411 and second upper 412. With this arrangement, first upper portion 451 and second upper portion 452 may fit first upper 411 and second upper 412, respectively.

By configuring an upper portion of a midsole with a different size than a lower portion of the midsole, the midsole may accommodate different sizes of an upper and an outsole. Referring to FIG. 6, first article 401 may be assembled by associating first upper portion 451 with first upper 411 and first lower portion 461 with first outsole 431. In a similar manner, second article 402 may be assembled by associating second upper portion 452 with second upper 412 and second lower portion 462 with second outsole 432.

In some embodiments, an outer peripheral edge of a midsole may accommodate the difference in sizes between an upper portion and a lower portion of a midsole. The term "outer peripheral edge" as used throughout this detailed description and in the claims refers to an outer portion of a midsole that extends from a lower portion of a midsole to an upper portion of a midsole. In some cases, an outer peripheral edge of a midsole may extend from an outsole to an upper. This may allow an outer peripheral edge of a midsole to be visible on an exterior of an article. By grading or contouring the outer peripheral edge of a midsole, the outer peripheral edge may accommodate different sizes of an upper portion and a lower portion of the midsole. With this arrangement, a midsole may provide a transition between an outsole and an upper of different sizes.

Referring to FIG. 5, first midsole 441 includes first outer peripheral edge 471. First outer peripheral edge 471 extends between first lower portion 461 and first upper portion 451. Similarly, second midsole 442 includes second outer peripheral edge 472. Second outer peripheral edge 472 extends between second lower portion 462 and second upper portion 452. With this arrangement, first outer peripheral edge 471 and second outer peripheral edge 472 may circumscribe first midsole 441 and second midsole 442, respectively.

An outer peripheral edge can be associated with a cross sectional profile shape. The term "cross sectional profile shape" as used throughout this detailed description and in the claims refers to a cross sectional shape of an outer peripheral edge as the outer peripheral edge extends between an upper portion and a lower portion of a midsole. In different embodiments, an outer peripheral edge can be configured with various cross sectional profile shapes, including, but not limited to, substantially flat shapes, curved shapes, convex curved shapes as well as concave curved shapes.

In some embodiments, an outer peripheral edge of a midsole may be associated with more than one cross sectional profile shape. For example, different cross sectional profile shapes may be associated with different portions of an outer peripheral edge such as a forefoot portion, an arch portion and/or a heel portion. In an exemplary embodiment, an outer peripheral edge of a midsole may be associated with a single cross sectional profile shape.

In one embodiment, first outer peripheral edge 471 may be graded outward as first outer peripheral edge 471 extends to first lower portion 461. Referring to the enlarged view of first outer peripheral edge 471 in FIG. 5, first outer peripheral edge 471 may have a concave cross sectional profile shape. The concave cross sectional profile shape can accommodate the smaller size of first upper portion 451 and larger size of first lower portion 461. With this arrangement, first outer peripheral edge 471 allows first midsole 441 to align with and fit the smaller size of first upper 411 and the larger size of first outsole 431.

In contrast, second outer peripheral edge 472 may be graded inward as second outer peripheral edge 472 extends to second lower portion 462. Referring to the enlarged view of second outer peripheral edge 472 in FIG. 5, second outer peripheral edge 472 may have a convex cross sectional profile shape. The convex cross sectional profile shape may accommodate the larger size of second upper portion 452 and smaller size of second lower portion 462. With this configuration of second outer peripheral edge 472, second midsole 442 may align with and fit a larger size of second upper 412 and a smaller size of second outsole 432.

In different embodiments, grading of a midsole can be achieved in various ways. In some embodiments, a midsole can be molded with a substantially vertical outer peripheral edge and graded or contoured by cutting or shaving an upper or lower portion of the midsole. For example, in one embodiment, a midsole configured to fit a size 6.5 upper and a size 6.25 outsole can be first created as a standard size 6.5 midsole. Using known methods in the art for cutting or shaving the edges of a sole, the outer peripheral edge of the sole can be contoured so that the lower portion of the midsole has a size 6.25. In other embodiments, a midsole can be molded with a contoured or graded edge. For example, in one embodiment a mold may be used to create a midsole with an upper portion that is associated with a size 6.5 and a lower portion that is associated with a size 6.25. In still other embodiments, a midsole with different sized upper and lower portions can be manufactured another manner.

Generally, each component of first article of footwear 401 and second article of footwear 402 may be constructed of any material. First upper 411 and second upper 412 may be made from any suitable material, including, but not limited to, nylon, natural leather, synthetic leather, natural rubber, or synthetic rubber. In addition, first midsole 441 and second midsole 442 may be constructed from any suitable material, including, but not limited to, elastomers, siloxanes, natural rubber, other synthetic rubbers, aluminum, steel, natural leather, synthetic leather, or plastics. In some cases, first midsole 441 and second midsole 442 may be made from a foam material. Also, first outsole 431 and second outsole 432 may be made from various suitable materials, including, but not limited to, elastomers, siloxanes, natural rubber, other synthetic rubbers, aluminum, steel, natural leather, synthetic leather, or plastics.

FIG. 8 illustrates an exemplary embodiment of table 800 that may be used for assembling an article of footwear with an upper and an outsole of different sizes. In some embodiments, table 800 may be part of a database that provides information for manufacturing articles of footwear. It should be understood, however, that table 800 is intended to be exemplary. In other embodiments, table 800 may include different and/or additional information.

In one embodiment, table 800 includes five attributes. In particular, table 800 includes article size 801, upper size 802, midsole upper portion size 803, midsole lower portion size 804 and outsole size 805. In some cases, article size 801, upper size 802 and midsole upper portion size 803 may include entries for standard footwear sizes. For example, article size 801, upper size 802 and midsole upper portion size 803 can include standard footwear sizes ranging from size 6 to 12.5. For instance, first row 811 includes entries of size 6 for article size 801, upper size 802, and midsole upper portion size 803. Likewise, second row 812 includes entries of size 6.5 for article size 801, upper size 802, and midsole upper portion size 803. In this embodiment, article size 801, upper size 802 and midsole upper portion size 803 may have 14 rows of data corresponding to the fourteen different standard footwear sizes of the exemplary embodiment.

In contrast, midsole lower portion size 804 and outsole size 805 may include sizes that are intermediate to standard footwear sizes. In some cases, midsole lower portion size 804 and outsole size 805 can include quarter sizes ranging from 6.25 to 12.25. With this arrangement, midsole lower portion size 804 and outsole size 805 can include seven rows of data, corresponding to the seven different intermediate sizes of the exemplary embodiment.

In some embodiments, this table can be used to determine the size of each component that is used to assemble an article of a particular standard footwear size. For example, third row 813 includes the sizing information necessary to manufacture an article of standard footwear size 7. In particular, a manufacturer needs an upper of size 7, as indicated in upper size 802. In addition, a midsole is needed with an upper portion size of 7 and a lower portion size of 7.25, as indicated by midsole upper portion size 803 and midsole lower portion size 804, respectively. Finally, an outsole with an intermediate size of 7.25 is needed, as indicated by outsole size 805. Using this information, a manufacturer can produce an upper, midsole and outsole with specified sizes in order to make a size 7 article of footwear.

The method of assembling articles discussed in this detailed description can provide increased manufacturing efficiency over traditional methods. By reducing the total number of outsole sizes required to manufacture articles of footwear in a range of standard footwear sizes, manufacturing costs and time can be substantially reduced. In some cases, the number of different outsole sizes that need to be produced can be reduced by almost fifty percent when compared to traditional methods using a distinct outsole for each standard footwear size.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. Articles of footwear, comprising:

a first article of footwear having a first upper having a first standard footwear size;

wherein the first article of footwear includes a first outsole having a first intermediate size that is smaller than the first standard footwear size; and wherein the first article of footwear includes a first midsole having an upper portion with the first standard footwear size and a lower portion with the first intermediate size;

a second article of footwear having a second upper having a second standard footwear size that is larger than the first standard footwear size by a standard sizing increment;

wherein the second article of footwear includes a second outsole having a second intermediate size that is larger than the second standard footwear size;

wherein the second article of footwear includes a second midsole having an upper portion with the second standard footwear size and a lower portion with the second intermediate size; and wherein the second intermediate size of the second outsole is larger than the first intermediate size of the first outsole by an amount that is double the standard sizing increment.

2. The article of footwear according to claim 1, wherein the first midsole has a contoured outer peripheral edge having a convex cross sectional profile shape.

3. The article of footwear according to claim 1, wherein the second midsole has a contoured outer peripheral edge having a concave cross sectional profile shape.

4. The article of footwear according to claim 1, wherein the first intermediate size of the first outsole differs in length from the first standard footwear size of the first upper; and wherein the first intermediate size differs in width from the first standard footwear size of the first upper.

5. The article of footwear according to claim 1, wherein the second standard footwear size is a half numerical size larger than the first standard footwear size.

6. The article of footwear according to claim 5, wherein the second intermediate size is a whole numerical size larger than the first intermediate size.

7. The article of footwear according to claim 5, wherein the first intermediate size is a quarter size smaller than the first standard footwear size, and wherein the second intermediate size is a quarter size larger than the second standard footwear size.

8. The article of footwear according to claim 1, wherein the first intermediate size of the first outsole differs in length from the second intermediate size of the second outsole; and wherein the first intermediate size differs in width from the second intermediate size of the second outsole.

9. Articles of footwear, comprising:

a first article of footwear including an upper having a first standard footwear size; and a second article of footwear including an upper having a second standard footwear size that is nearest the first standard footwear size;

wherein the first article of footwear includes a first outsole having an intermediate size between the first standard footwear size and the second standard footwear size;

wherein the second article of footwear includes a second outsole having the same intermediate size as the first outsole;

wherein the first article of footwear includes a first midsole having a first upper portion having the first standard footwear size and a first lower portion having the intermediate size;

wherein the second article of footwear includes a second midsole having a second upper portion having the second standard footwear size and a second lower portion having the intermediate size;

wherein the first midsole has an outer peripheral edge with a first cross sectional profile shape, and the second midsole has an outer peripheral edge with a second cross sectional profile shape that is different than the first cross sectional profile shape; and wherein the first cross sectional profile shape is convex and the second cross sectional profile shape is concave.

10. The articles of footwear according to claim 9, wherein the second standard footwear size is a half numerical size larger than the first standard footwear size.

11. The articles of footwear according to claim 9, wherein the numerical value of the intermediate size is the arithmetic average of the first standard footwear size and the second standard footwear size.

12. The articles of footwear according to claim 9, wherein the intermediate size is a quarter size larger than the first standard footwear size and wherein the intermediate size is a quarter size smaller than the second standard footwear size.

13. The articles of footwear according to claim 9, wherein the first outsole has a first length and the first upper has a second length and wherein the difference between the first length and the second length is in a range between 1 and 3 millimeters.

14. The articles of footwear according to claim 9, wherein the first outsole has a first forefoot width and the first upper has a second forefoot width and wherein the difference between the first forefoot width and the second forefoot width is in a range between 0.5 and 1.5 millimeters.

15. The articles of footwear according to claim 9, wherein the first outsole has a first heel width and the first upper has a second heel width and wherein the difference between the first heel width and the second heel width is in a range between 0.5 and 1.5 millimeters.

16. Articles of footwear, comprising:

a first article of footwear including an upper having a first standard footwear size having a first length and a first width; and a second article of footwear including an upper having a second standard footwear size that is nearest the first standard footwear size and larger than the first standard footwear size by a standard sizing increment, the second standard footwear size having a second length and a second width;

a third article of footwear including an upper having a third standard footwear size that is nearest the second standard footwear size and larger than the second standard footwear size by the standard sizing increment, the third standard footwear size having a third length and a third width; and a fourth article of footwear including an upper having a fourth standard footwear size that is nearest the third standard footwear size and larger than the third standard footwear size by the standard sizing increment, the fourth standard footwear size having a fourth length and a fourth width;

wherein the first article of footwear includes a first outsole having a first intermediate size between the first standard footwear size and the second standard footwear size, the first intermediate size having a first intermediate length and a first intermediate width;

wherein the second article of footwear includes a second outsole having the first intermediate size;

wherein the first article of footwear includes a first midsole having a first upper portion having the first standard footwear size and a first lower portion having the first intermediate size;

wherein the second article of footwear includes a second midsole having a second upper portion having the second standard footwear size and a second lower portion having the first intermediate size; and wherein the first intermediate size is a quarter size larger than the first standard footwear size and wherein the first intermediate size is a quarter size smaller than the second standard footwear size;

wherein the third article of footwear includes a third outsole having a second intermediate size between the third standard footwear size and the fourth standard footwear size, the second intermediate size having a second intermediate length and a second intermediate width;

wherein the fourth article of footwear includes a fourth outsole having the second intermediate size;

wherein the third article of footwear includes a third midsole having a first upper portion having the third standard footwear size and a third lower portion having the second intermediate size;

wherein the fourth article of footwear includes a fourth midsole having a fourth upper portion having the fourth standard footwear size and a fourth lower portion having the second intermediate size; and wherein the second intermediate size is a quarter size larger than the third standard footwear size and wherein the second intermediate size is a quarter size smaller than the fourth standard footwear size.

17. The articles of footwear according to claim 16, wherein the difference between the first intermediate length of the first outsole and the first length of the first upper is in a range between 1 and 3 millimeters.

18. The articles of footwear according to claim 16, wherein the first outsole has a first forefoot width and the first upper has a second forefoot width and wherein the difference between the first forefoot width and the second forefoot width is in a range between 0.5 and 1.5 millimeters.

19. The articles of footwear according to claim 16, wherein the first outsole has a first heel width and the first upper has a second heel width and wherein the difference between the first heel width and the second heel width is in a range between 0.5 and 1.5 millimeters.

20. The articles of footwear according to claim 16, wherein the numerical value of the first intermediate size is the arithmetic average of the first standard footwear size and the second standard footwear size.

21. The articles of footwear according to claim 16, wherein the second intermediate size is larger than the first intermediate size by an amount that is double the standard sizing increment.

* * * * *